US011680467B2

(12) United States Patent
Morgan

(10) Patent No.: US 11,680,467 B2
(45) Date of Patent: Jun. 20, 2023

(54) GOPHER TRAP

(71) Applicant: OGMS, LLC, Orange Grove, TX (US)

(72) Inventor: Richard Morgan, Sandia, TX (US)

(73) Assignee: OGMS, LLC, Orange Grove, TX (US)

( * ) Notice: Subject to any disclaimer, the term of this patent is extended or adjusted under 35 U.S.C. 154(b) by 0 days.

(21) Appl. No.: 17/856,315

(22) Filed: Jul. 1, 2022

(65) Prior Publication Data

US 2022/0333465 A1 Oct. 20, 2022

Related U.S. Application Data

(63) Continuation of application No. 16/440,280, filed on Jun. 13, 2019.

(60) Provisional application No. 62/693,257, filed on Jul. 2, 2018.

(51) Int. Cl.
*E21B 43/08* (2006.01)
*E21B 43/25* (2006.01)

(52) U.S. Cl.
CPC ..... *E21B 43/086* (2013.01); *E21B 43/25* (2013.01)

(58) Field of Classification Search
CPC ..... E21B 43/086; E21B 43/08; E21B 43/25
See application file for complete search history.

(56) References Cited

U.S. PATENT DOCUMENTS 4,495,073 A 1/1985 Beimgraben
5,664,628 A 9/1997 Koehler et al.
7,165,633 B2 1/2007 Hall et al.
D747,785 S * 1/2016 Ruprecht ..... D23/262
9,616,371 B1 4/2017 Clements
9,816,338 B1 11/2017 Hanson et al.
2005/0109503 A1 5/2005 Kutryk
2006/0065444 A1 3/2006 Hall et al.
2006/0151379 A1 7/2006 Fobe et al.
2007/0108117 A1 5/2007 Callaert et al.
2007/0151231 A1 7/2007 Rinaldi
2010/0236833 A1 9/2010 Hall et al.
2018/0313178 A1 11/2018 Biggerstaff et al.

OTHER PUBLICATIONS

USPTO Non-Final Office Action for U.S. Appl. No. 16/440,280 dated May 13, 2020.
USPTO Final Office Action for U.S. Appl. No. 16/440,280 dated Oct. 7, 2020.
USPTO Non-Final Office Action for U.S. Appl. No. 16/440,280 dated Feb. 24, 2021.
USPTO Final Office Action for U.S. Appl. No. 16/440,280 dated Aug. 16, 2021.
USPTO Non-Final Office Action for U.S. Appl. No. 16/440,280 dated Dec. 13, 2021.
USPTO Final Office Action for U.S. Appl. No. 16/440,280 dated Apr. 1, 2022.

* cited by examiner

*Primary Examiner* — Taras P Bemko
(74) *Attorney, Agent, or Firm* — Tumey L.L.P.

(57) ABSTRACT

A perforated filtration insert includes a head unit and a body portion having perforated side walls. The body portion is closed at one end by a cap such that fluid entering the body exits through the perforations in the side walls of the insert.

4 Claims, 4 Drawing Sheets

GOPHER TRAP

This application is a continuation of U.S. application Ser. No. 16/440,280 filed on Jun. 13, 2019, which claims priority to U.S. Provisional Patent Application Ser. No. 62/693,257 filed Jul. 2, 2018, the entire contents of which are expressly incorporated herein by reference thereto.

BACKGROUND OF THE INVENTION

Field of the Invention

The present invention relates to oil and gas production and, more particularly, in one or more embodiments, the present invention relates to a perforated insert designed for filtration of an injection fluid.

Background of the Invention

Currently, to stimulate a subterranean formation, a fluid is injected into the formation through production tubing. Often, the fluid available to be injected is contaminated with debris. Problems may arise, such as tool failure or safety hazards, when such debris travels downhole through other equipment. Therefore, there is a need for systems and methods to filter out the debris from an injection fluid.

BRIEF SUMMARY OF SOME OF THE PREFERRED EMBODIMENTS

The invention disclosed herein is directed to a filtering device that may be positioned within tubing, for example production tubing, to prevent contaminants from being injected into the well during well treating processes.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
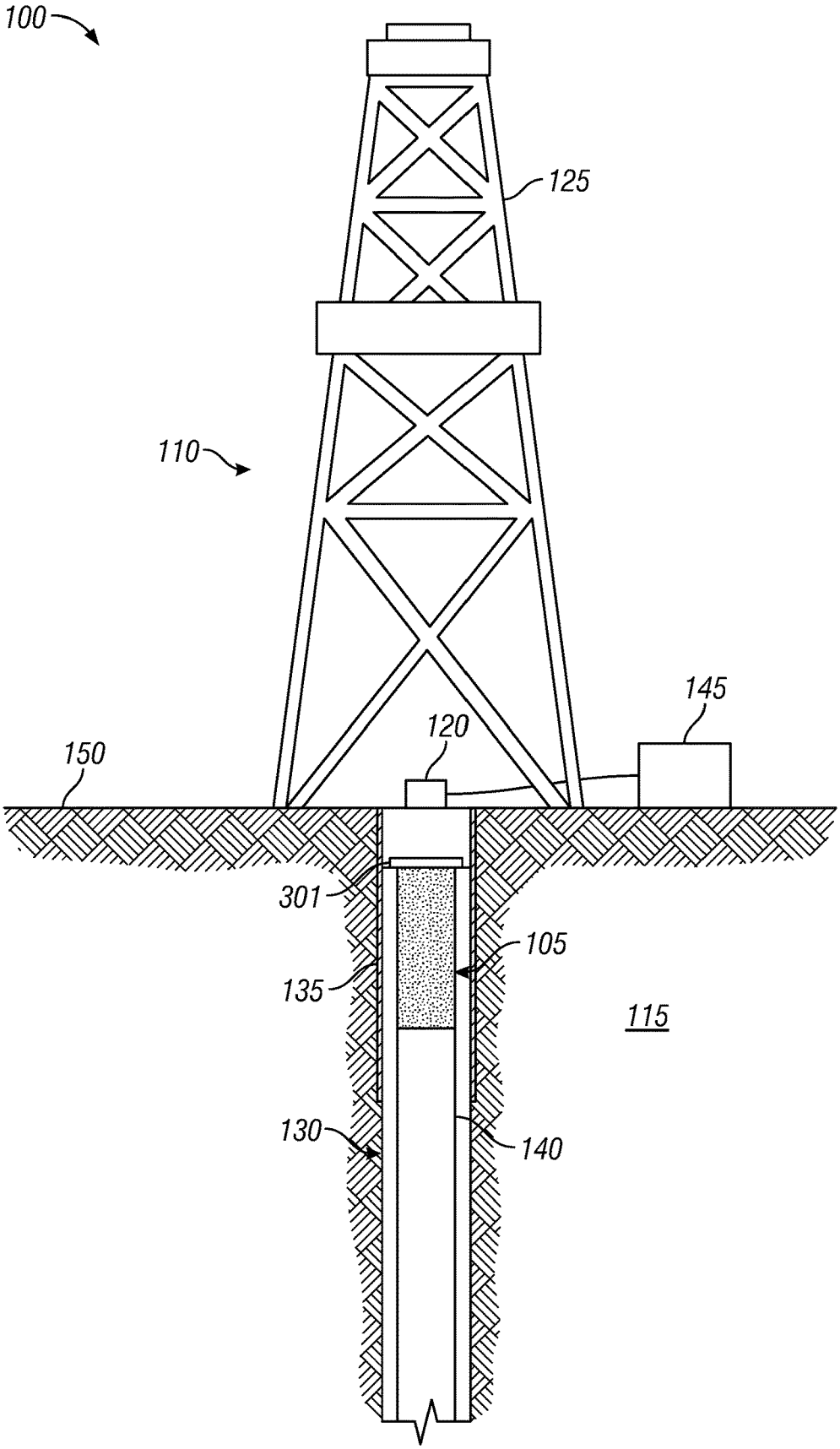
FIG. 1 illustrates a well system.

FIG. 1 illustrates a well system 100 that includes a perforated filtration insert 105. As illustrated, there may be surface equipment 110 disposed above a formation 115. In examples, surface equipment 110 may include a hoisting apparatus 120 and a derrick 125. Hoisting apparatus 120 may be used for raising and lowering tubular strings into a wellbore 130. In examples, wellbore 130 may extend through formation 115. A casing 135 may be secured within wellbore 130 by cement (not shown). Casing 135 may be made from any material such as metals, nonmetals, plastics, composites, or the like. Additionally, it may not be necessary for casing 135 to be cemented into wellbore 130. In embodiments, a production tubing 140 may be disposed within casing 135. Production tubing 140 may be any suitable tubing string utilized in the production of hydrocarbons.

In embodiments, information concerning operations for the production of hydrocarbons and/or other related data may be collected by well system 100. Information collected by well system 100 may be processed by an analysis unit 145. The processing may be performed real-time and/or after certain operations. Processing may occur underground and/or at a surface 150. Analysis unit 145 may process signals, and information contained therein may be displayed for an operator to observe and stored for future processing and reference. In examples, an operator may be defined as an individual, group of individuals, or an organization. Analysis unit 145 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, analysis unit 145 may be a processing unit, a network storage device, or any other suitable device and may vary in size, shape, performance, functionality, and price. Analysis unit 145 may include random access memory (RAM), one or more processing resources such as a central processing unit (CPU) or hardware or software control logic, ROM, and/or other types of nonvolatile memory. Additional components of analysis unit 145 may include one or more disk drives, one or more network ports for communication with external devices as well as an input device (e.g., keyboard, mouse, etc.) and video display. Analysis unit 145 may also include one or more buses operable to transmit communications between the various hardware components.

Alternatively, systems and methods of the present disclosure may be implemented, at least in part, with non-transitory computer-readable media. Non-transitory computer-readable media may include any instrumentality or aggregation of instrumentalities that may retain data and/or instructions for a period of time. Non-transitory computer-readable media may include, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Figure 2:
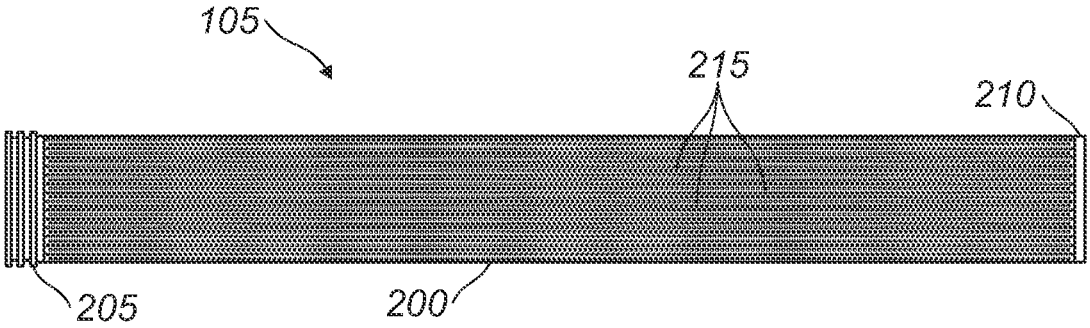
FIG. 2 is a side view of a perforated filtration insert according to an embodiment of the invention.
Figure 4:
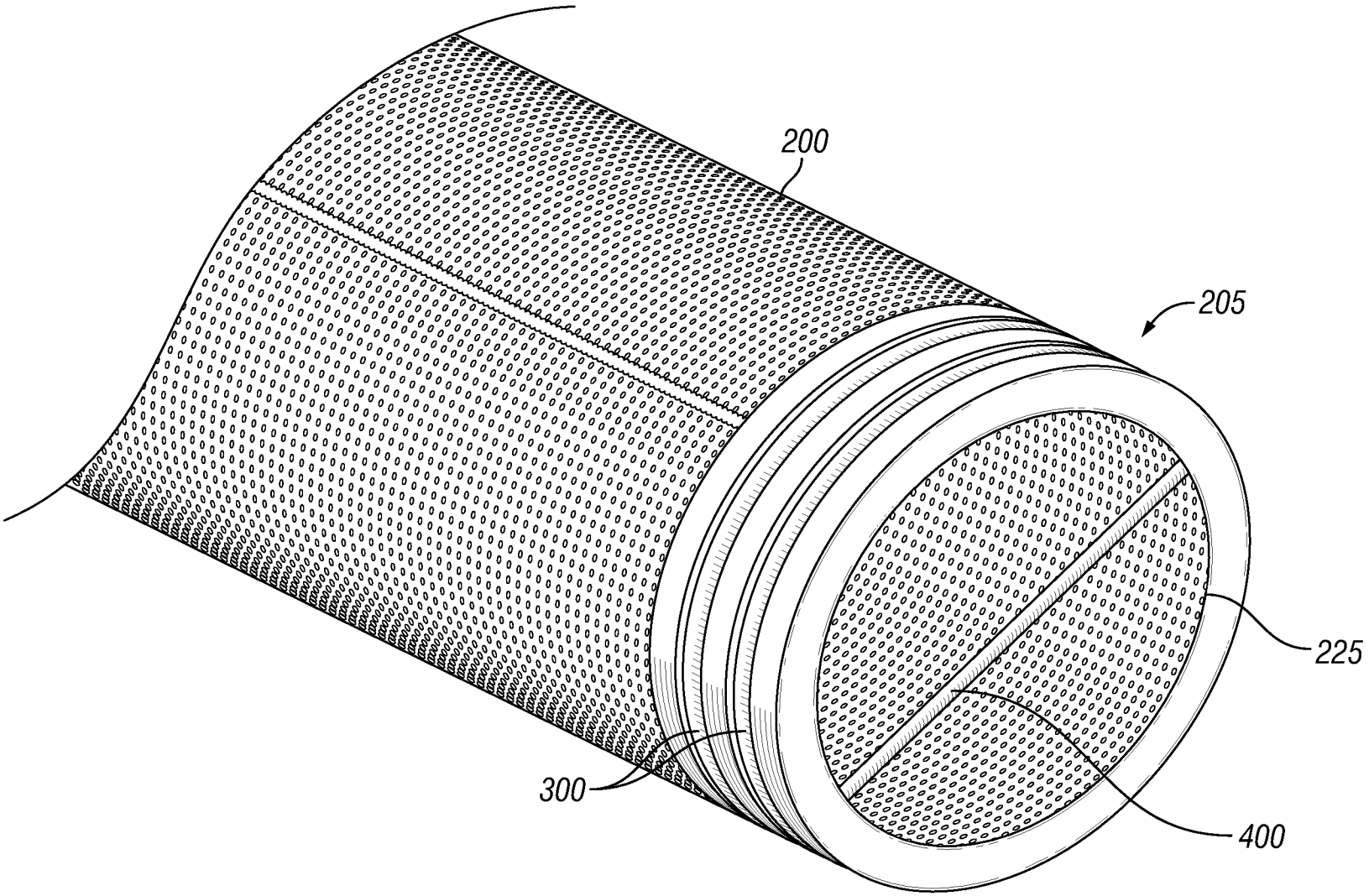
FIG. 4 is a perspective view of top portion of the filter.

As illustrated, perforated filtration insert 105 may be disposed on, in, and/or around production tubing 140. In embodiments, perforated filtration insert 105 may be disposed about a proximal end of production tubing 140 near surface 150. It should be understood by those of ordinary skill that while perforated filtration insert 105 is illustrated as a surface unit, perforated filtration insert 105 may be disposed at any depth along production tubing 140. As shown on FIG. 2, perforated filtration insert 105 may include a body 200, a head unit 205, and a cap 210. In embodiments, head unit 205 may be disposed about a first end of body 200, wherein head unit 205 is uphole. Cap 210 may be disposed about a second end of body 200, wherein cap 210 is downhole. Body 200 may be formed from perforated sheet metal rolled into a cylinder as shown in FIG. 4. Once formed the circular top of body 200 can be placed within a circular groove 303 in the head unit 205 and welded in place. This centers the header ring before welding and adds strength to the weld.

Body 200 may function to filter out any suitable debris present in a fluid that interacts with perforated filtration insert 105. Body 200 may be made from any suitable material. Suitable materials may include, but are not limited to, metals, nonmetals, polymers, ceramic, and/or combinations thereof. In embodiments, body 200 may be made from stainless steel. Body 200 may be any suitable size, height, and/or shape. Without limitations, the length of body 200 may be between from about 1 inch to about 20 inches, from about 20 inches to about 40 inches, from about 40 inches to about 60 inches, from about 60 inches to about 80 inches, or from about 80 inches to about 100 inches. In a preferred embodiment, body 200 may have a length between a range of about 55 inches and 70 inches. Without limitation, a suitable shape may include, but is not limited to, cross-sectional shapes that are circular, elliptical, triangular, rectangular, square, hexagonal, and/or combinations thereof. In embodiments, body 200 may be a tubular with a circular cross-sectional shape. Body 200 may include a central passage that traverses the length of body 200. In embodiments, there may be perforations 215 disposed throughout body 200. Perforations 215 may be openings allowing access from the interior of body 200 to the exterior of body 200 and/or vice versa. Perforations 215 may be any suitable size, height, and/or shape. In embodiments, perforations 215 may have a circular cross-sectional shape. Perforations 215 may be uniform and/or non-uniform in shape, size, spread across body 200, and/or combinations thereof. Without limitations, perforations 215 may have a diameter between a range of about 1/100 of an inch to about 1/50 of an inch, from about 1/50 of an inch to about 1/25 of an inch, from about 1/25 of an inch to about 1/10 of an inch, or from about 1/10 of an inch to about 1/2 of an inch. In certain embodiments, the diameter of perforations 215 may be between about 1/16 of an inch to about 1/4 of an inch.

Figure 3:
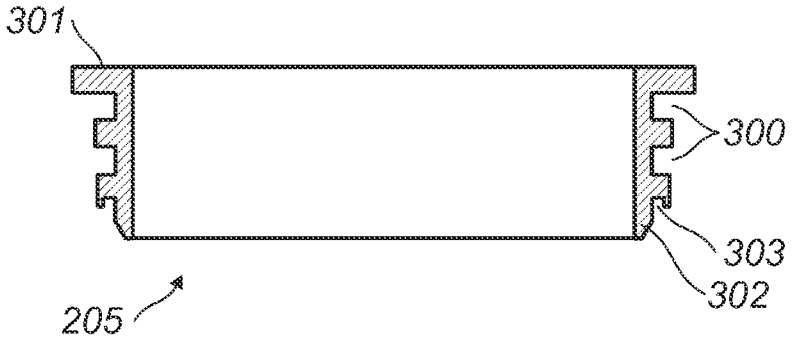
FIG. 3 is a cross sectional view of the top portion unit of the filter.

FIGS. 3 and 4 illustrate an embodiment of head unit 205. Head unit 205 may be made from any suitable material. Suitable materials may include, but are not limited to, metals, nonmetals, polymers, ceramic, and/or combinations thereof. Head unit 205 may be any suitable size, height, and/or shape. In embodiments, the inner diameter of head unit 205 may be the same as the inner diameter of body 200. In alternate embodiments, the inner diameter of head unit 205 may be different from and/or concentric with the inner diameter of body 200. Head unit 205 may provide an access point to perforated filtration insert 105 for an operator. Additionally, head unit 205 may provide a seal against the interior of production tubing 140. As illustrated, head unit 205 may include a groove 300 for a suitable sealing element. Without limitation, the suitable sealing element may be an O-ring. There may be a plurality of grooves 300 in head unit 205. The plurality of grooves 300 may be disposed external to head unit 205. In embodiments, as perforated filtration insert 105 is disposed into production tubing 140, head unit 205 may provide a pressure seal between surface 145 and wellbore 130. Body 200 may fit within the interior of head unit 205 and be secured thereto by any known method such as welding.

As shown in FIG. 3 head unit 205 includes an enlarged flange 301 that is adapted to sit on top of the tubing or a vessel to prevent the filter from falling into the tube. Head unit 205 also includes an annular grove 303 and a beveled surface 302.

Head unit 205 may additionally include a handle 400. Handle 400 may be a structure to be grasped by an operator in order to displace perforated filtration insert 105. Handle 400 may be made from any suitable material. Handle 400 may be any suitable size, height, and/or shape. Handle 400 may be disposed to head unit 205 by using any suitable mechanism including, but not limited to, through the use of suitable fasteners, threading, adhesives, snap-fit methods, welding, and/or any combination thereof. In embodiments, handle 400 may be disposed to head unit 205 by welding the ends of handle 400 to a proximal end of head unit 205, wherein the proximal end of head unit 205 is opposite of first end of body 200 and accessible at surface 150.

Figure 5:
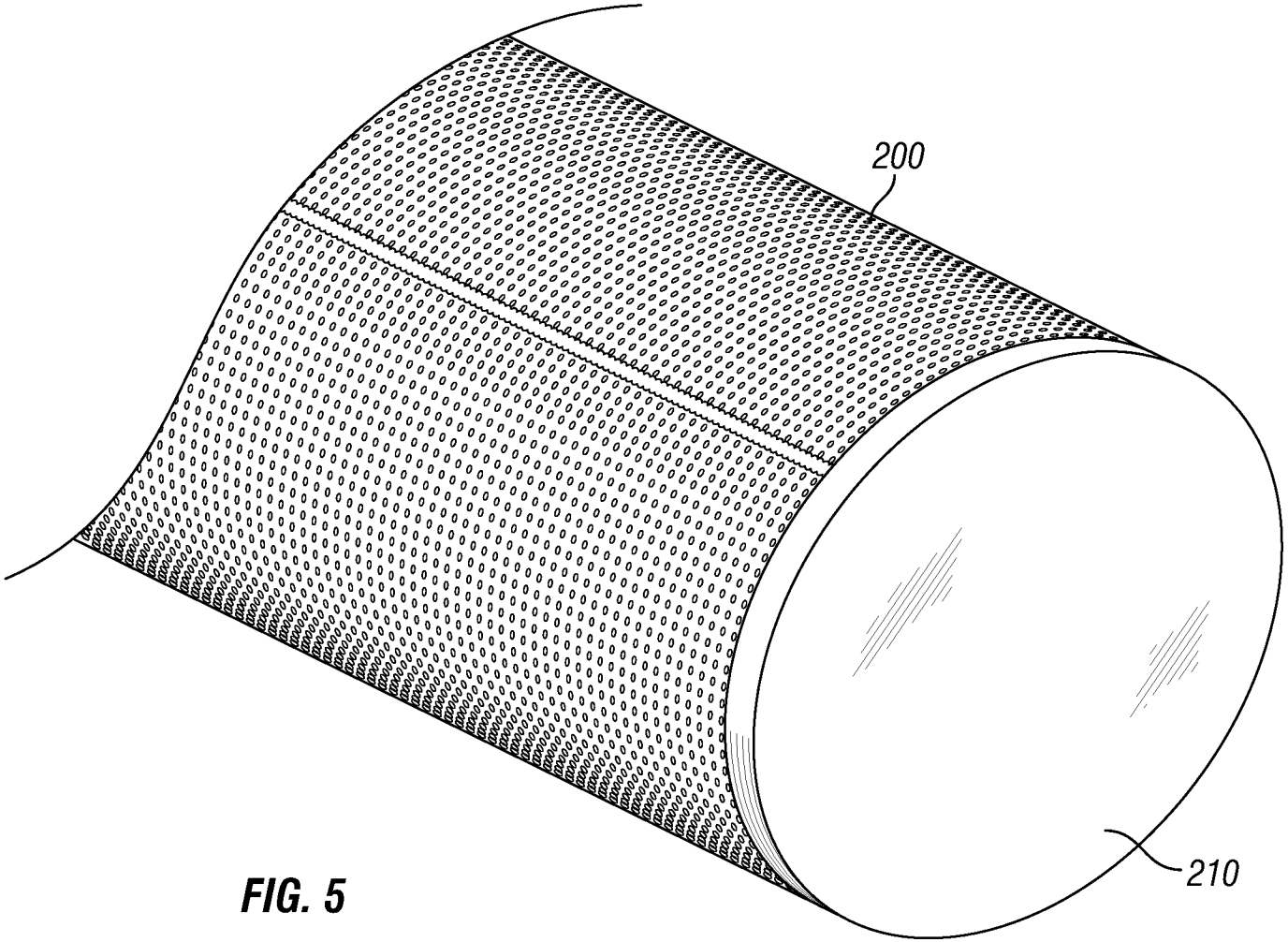
FIG. 5 is a perspective view of the bottom portion of the filter.

FIG. 5 illustrates an embodiment of cap 210. Cap 210 may be made from any suitable material. Suitable materials may include, but are not limited to, metals, nonmetals, polymers, ceramic, and/or combinations thereof. In embodiments, cap 210 may be made from stainless steel. Cap 210 may be any suitable size, height, and/or shape. Without limitation, a suitable shape may include, but is not limited to, cross-sectional shapes that are circular, elliptical, triangular, rectangular, square, hexagonal, and/or combinations thereof. In embodiments, cap 210 may have a circular cross-sectional shape. As previously described, cap 210 may be disposed about a second end of body 200. In embodiments, the diameter of cap 210 may be the same as the outer diameter or inner diameter of body 200. In alternate embodiments, the diameter of cap 210 may be different from and/or concentric with the outer diameter or inner diameter of body 200. Cap 210 may be disposed to body 200 by using any suitable mechanism, including, but not limited, through the use of suitable fasteners, threading, adhesives, snap-fit methods, welding, and/or any combination thereof. In embodiments, cap 210 may be disposed to body 200 through welding.

In embodiments, perforated filtration insert 105 may be disposed into production tubing 140. Once head unit 205 of perforated filtration insert 105 has sealed against production tubing 140, an injection fluid may be pumped downhole. In embodiments, the injection fluid may travel through perforated filtration insert 105 by entering into head unit 205. The injection fluid may travel through the central passage of body 200 and encounter cap 210. Cap 210 may restrict the flow of the injection fluid. In embodiments, the injection fluid may be forced to exit the body 200 through perforations 215. As the injection fluid travels through perforations 215, any debris previously present in the injection fluid may be separated from the injection fluid and remain inside perforated filtration insert 105. The injection fluid may travel further downhole without the presence of large-sized debris, wherein the large-sized debris has an overall size that is bigger than the diameter of perforations 215. In embodiments, portions of debris may become stuck within perforations 215. Perforations 215 may be temporarily clogged. In embodiments, perforated filtration insert 105 may be removed from production tubing 140 in order to clean out the debris that was filtered out of the injection fluid and/or clogged within perforations 215.

The foregoing figures and discussion are not intended to include all features of the present techniques to accommodate a buyer or seller, or to describe the system, nor is such figures and discussion limiting but exemplary and in the spirit of the present techniques.

What is claimed is:

1. A perforated filtration insert for filtering a fluid injected into a wellbore, comprising:

a) a head unit having an inlet and comprising an enlarged flange adapted to sit on top of production tubing, b) a body unit formed from perforated sheet metal rolled into a cylinder to form a cylindrical body unit having an internal flow path and perforated walls, wherein a circular end of the cylindrical body unit is placed within and attached to a circular groove of the head unit, c) a cap secured to a bottom of the body unit and closing the internal flow path whereby fluid entering the insert from the head unit is forced through the perforations in the walls of the cylindrical body unit;

wherein the perforated walls comprise perforations sized between 1/25 of an inch to 1/2 of an inch; and wherein the perforated filtration insert is disposed in production tubing in a wellbore with the enlarged flange positioned on top of the production tubing while a proximal end of the head unit is accessible at a surface from which the wellbore extends.

2. A perforated filtration insert as claimed in claim 1 wherein the head unit further includes a handle.

3. A perforation filtration insert as claimed in claim 1 wherein the head unit includes one or more annular grooves on an outer surface and one or more O-rings positioned in the grooves.

4. A perforated filtration insert as claimed in claimed in claim 1 wherein the cylinder is formed by welding abutting edges of the perforated sheet metal together.

* * * * *